US011287208B2

(12) United States Patent
Apolczer

(10) Patent No.: US 11,287,208 B2
(45) Date of Patent: Mar. 29, 2022

(54) METHOD FOR IMPROVING THE EFFICIENCY OF RECOIL BRAKE AND GUN PROVIDED WITH RECOIL BRAKE

(71) Applicants: Tibor Feher, Bodajk (HU); Ferenc Apolczer, Mor (HU)

(72) Inventor: Ferenc Apolczer, Mor (HU)

( * ) Notice: Subject to any disclaimer, the term of this patent is extended or adjusted under 35 U.S.C. 154(b) by 0 days.

(21) Appl. No.: 17/040,259

(22) PCT Filed: Mar. 22, 2019

(86) PCT No.: PCT/HU2019/000006
§ 371 (c)(1),
(2) Date: Sep. 22, 2020

(87) PCT Pub. No.: WO2019/180471
PCT Pub. Date: Sep. 26, 2019

(65) Prior Publication Data

US 2021/0010774 A1 Jan. 14, 2021

(30) Foreign Application Priority Data

Mar. 23, 2018 (HU) ..... P1800103

(51) Int. Cl.
*F41A 21/36* (2006.01)

(52) U.S. Cl.
CPC ..... *F41A 21/36* (2013.01)

(58) Field of Classification Search
CPC ..... F41A 21/36
(Continued)

(56) References Cited

U.S. PATENT DOCUMENTS 4,141,275 A * 2/1979 Hollingsworth ..... F41A 1/08 89/1.703
5,353,681 A * 10/1994 Sugg ..... F41A 25/16 89/177
2021/0123699 A1* 4/2021 Berean ..... F41A 3/66

FOREIGN PATENT DOCUMENTS

HU 1400120 A1 9/2015
HU 1400120 B1 3/2018

* cited by examiner

*Primary Examiner* — Samir Abdosh
(74) *Attorney, Agent, or Firm* — Olson & Cepuritis, Ltd.

(57) ABSTRACT

The invention relates to a gun provided with recoil brake (14) and a method for improving the efficiency of the same. During the method a portion of the gunpowder gases burnt by means of the oxidant present in the barrel (2) of the gun but still containing inflammable material is introduced as the primary medium from the barrel (2) of the gun into the nozzle (9) of an ejector and the secondary medium is thus pumped in for forming a pre-mixture which is introduced into the combustion chamber of a pulsating reactive drive mechanism (10) acting in a direction opposite to the direction of the shot. This mixture is further burnt by means of the medium containing oxidant present in the drive mechanism (10), the combustion product is led out through the blow pipe (18) and the flow-back taking place during combustion is avoided by means of a valve. The barrel has gas port openings (3) from which the gunpowder gases as primary medium are introduced into the mixed medium transport duct (5) connected to the secondary medium transport duct (4) of the variable operation ejector (8), and in this manner the external oxidant containing medium is pumped in. This mixture from the direction of the nozzle (9) is introduced into the combustion chamber (13) of a pulsating reactive drive mechanism (10), and the flow back is prevented by the ram pressure of the mixture flowing into the combustion chamber (13) through the nozzle (9). The medium present in
(Continued)

the combustion chamber (13) is compressed and after the pressure exceeds the pressure in the barrel (2) due to the processes taken place in the combustion chamber (13) and the flow turns back, the combustion product gases as a new primary medium flowing through the nozzle (9) together with the medium transported from the barrel (2) through the mixed medium transport duct (5) and with the medium again transported from the external environment through the secondary medium transport duct (4) is pressed into the afterburner chamber (17) provided on the other side of the variable operation ejector (8) where this mixture is further burnt in the presence of a catalyst reducing the activation energy of the combustible material, then the combustion product is exhausted through the blow pipe (18).

5 Claims, 1 Drawing Sheet

(58) Field of Classification Search
USPC ..... 89/14.3
See application file for complete search history.

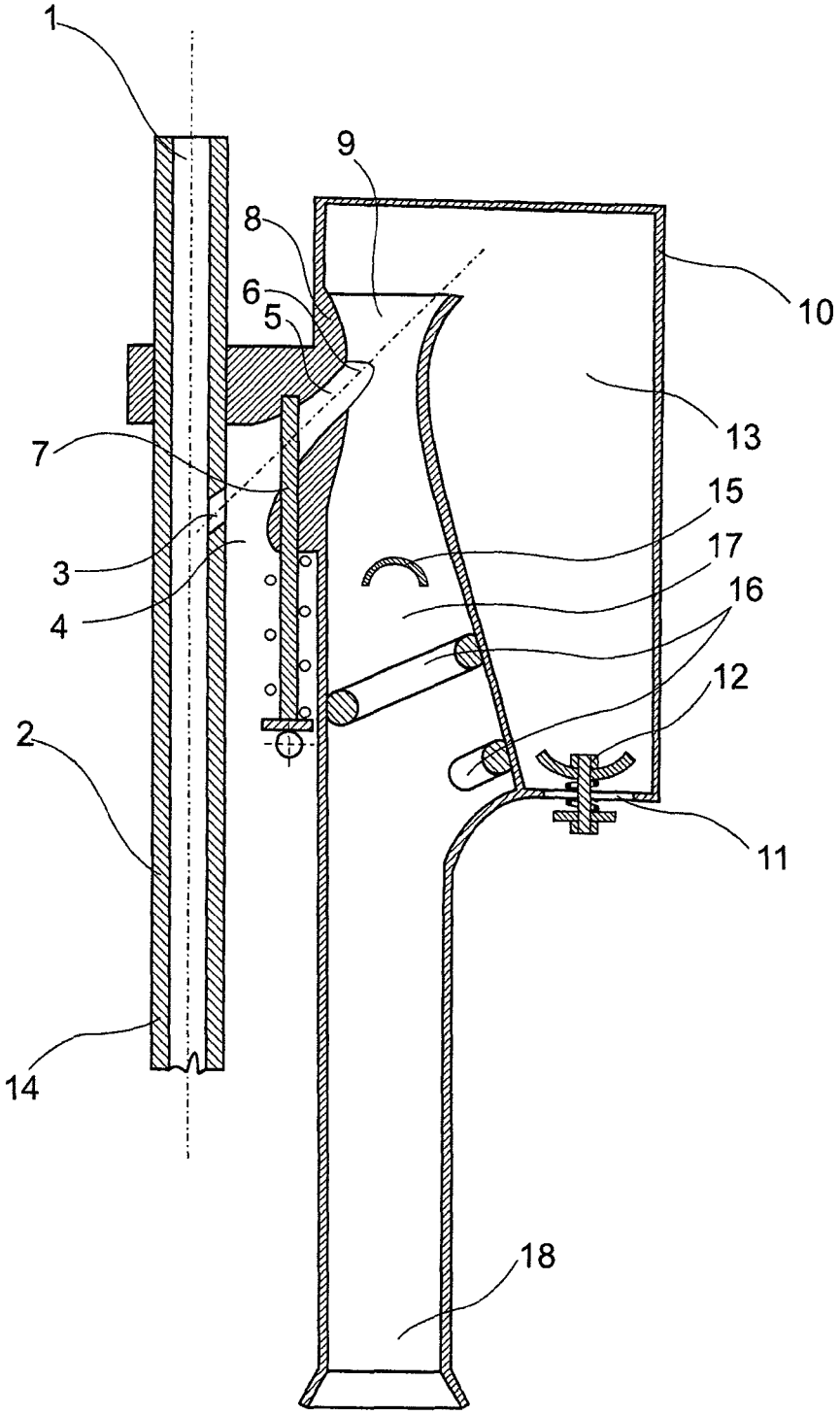
1
9
8
6
5
10
13
7
15
17
3
16
4
12
2
11
14
18

METHOD FOR IMPROVING THE EFFICIENCY OF RECOIL BRAKE AND GUN PROVIDED WITH RECOIL BRAKE

The invention relates to a method for reduction of reaction of guns and gun provided with recoil brake which makes changing of the characteristics of operation possible in a larger extent. Differently from the Hungarian patent application HU 230756 the present invention does not deal with the afterburner which is formed by the combustion chamber of the barrel and the subassembly of the recoil brake drive mechanism. The present invention relates to a method during which the combustion of the mixture of the gunpowder gas entering from the barrel and the outer medium takes place in the combustion chamber and the afterburner chamber of the subassembly of the recoil brake drive mechanism.

Patent application HU 230756 describes a method for reduction of reaction of firearms in which following the completion of the burning process in the barrel after leading the gunpowder gases from the closer part of the muzzle through the ejector (compressive jet-pump) in order to reach the required efficiency, the combustible pre-mixture keeps burning in the pulsating jet-engine. The disadvantage of this solution is that when the combustible material is charged the medium is able to leave from the drive mechanism without reaction. Further, the oxidant used for the continued combustion—especially in case of low concentration of the required amount of effective agent (e.g. air)—could be introduced only by a relatively large drive mechanism. Charging of the relatively large drive mechanism with combustible before the firing stroke needs more time which involves delay in operation. In this manner the firearm may move backwards on a longer path without restraint. A further disadvantage is that flow of the gunpowder gases from the barrel to the drive mechanism takes place through ducts which change the way of the medium. Consequently less mixture of combustible material enters into the pulsating reactive drive mechanism as the flow significantly slows down.

The aim of the present invention is to improve the efficiency of the recoil brake and to reduce its size and the delay of its efficiency.

To this as much combustible material and oxidants as possible should be introduced from the barrel to the drive mechanism of the recoil brake. Conditions must be ensured for development of the favourably high pressure in the combustion chamber(s), for possibility of after-burn of the combustible material and safe operation under any circumstances.

The invention is based on the realization that the recoil brake can be operated more efficiently using a suitably designed barrel, by suitably designing the subassembly of the pulsating reactive drive mechanism and by suitably designing and arranging the ejector.

It has been realized that it is very important to introduce as much gunpowder gas as possible into the drive mechanism. Therefore in case of the high pressure and the high exit velocity of gas (>>1 Mach) at the barrel gas port opening the portion of the duct between the barrel gas port opening and the combustion chamber cannot be a highly resistant reversing channel. Instead, the barrel gas port opening must be similar to the Laval nozzle and gases must enter to the combustion chamber through a rather straight path.

It has also been realized that in order to control the flow through the nozzle the duct transporting the mixed medium is built in the end of the nozzle which is closer to the combustion chamber so that together with the nozzle the pulse exchange between the transported mediums becomes again possible, providing another ejector. In this ejector the duct transporting the mixed medium streaming out from the narrowest portion of the nozzle is directed towards the combustion chamber in such a manner that during operation due to the ram pressure of the mixture driven by the gunpowder gas flow back from the combustion chamber towards the nozzle is prevented until pressure compensation takes place.

Further, it has been realized that the above mentioned 'variable operation' ejector is also suitable for reducing the back-flow from the ejector as following the pressure compensation between the combustion chamber and the barrel the medium entering into the nozzle from the combustion chamber induces 'suction' effect towards the secondary duct of the ejector and the barrel (Venturi effect).

Accordingly, in one aspect the invention is a method for improving the efficiency of the recoil brake. During the method a portion of the gunpowder gases which is burnt by means of the oxidant present in the barrel of the gun but still containing inflammable material is introduced as the primary medium from the barrel of the gun into the nozzle of an ejector and the secondary medium is thus pumped in for forming a pre-mixture. Then it is introduced into the combustion chamber of a pulsating reactive drive mechanism acting in a direction opposite to the direction of the shot where this mixture is further burnt by means of the medium containing oxidant present in the drive mechanism. The combustion product is led out through the blow pipe and the unbeneficial flow-back taking place during combustion is avoided by means of the one-way valve. In the method barrel gas port openings are used from which the gunpowder gases as primary medium are introduced into the mixed medium transport duct connected to the secondary medium transport duct of the variable operation ejector. The external medium containing oxidants is pumped in then this mixture from the direction of the nozzle is introduced into the combustion chamber of a pulsating reactive drive mechanism and the flow back is prevented by the ram pressure of the mixture flowing into the combustion chamber through the nozzle. Further, the medium present in the combustion chamber is compressed and after the pressure exceeds the pressure in the barrel due to the processes taken place in the combustion chamber and the flow turns back, the medium flowing through the nozzle together with the medium transported from the barrel through the mixed medium transport duct and with the medium again transported from the external environment through the secondary medium transport duct is pressed into the afterburner chamber provided on the other side of the variable operation ejector where this mixture is further burnt in the presence of the material reducing the activation energy of the combustible material then the combustion product is exhausted through the blow pipe.

Advantageous implementations of the method will be defined by the appended claims.

In another aspect the invention is a gun provided with recoil brake. A pulsating reactive drive mechanism acting in a direction opposite to the direction of the shot is connected to the barrel. The pulsating reactive drive mechanism has an intake opening provided with a mechanic valve and a blow pipe through which the combustion product is exhausted. From the portion of the barrel nearer to the muzzle a duct forming a part of an ejector the axis of which is different from the axis of the barrel is provided, the ducts of the ejector on the one side are directed towards the interior space of the barrel and the external environment while on the other side they are directed towards the combustion chamber of the pulsating reactive drive mechanism. The barrel is provided with gas port opening(s) formed similarly to the interior of the Laval nozzle and the axis of the gas port openings are directed from the interior space of the barrel towards the mixed medium transport duct of the variable operation ejector of the recoil brake. The outward opening of this duct is led out at the narrowest cross-section of the nozzle forming a part of the variable operation ejector and faces the combustion chamber. Opposite the combustion chamber on the other side of the nozzle the gun provided with recoil brake is provided with an afterburner chamber.

Advantageous embodiments of the recoil brake will be defined by the appended claims.

The greater compression, the prevention of the early discharge of the load and the fact that medium containing oxidants can be introduced into the afterburner chamber due to the medium flow through the variable operation ejector and the nozzle make the recoil brake to be designed as small as possible. For the combustion in the afterburner chamber the capacity of the combustion chamber of the pulsating reactive drive mechanism must be measured so that the pressure produced in it should reverse the direction of the flow in time in the interest of the small action delay but the kinetic energy of the medium leaving from the combustion chamber through the nozzle of the variable operation ejector should be great enough to transport as much gunpowder gas as possible from the barrel through the mixed medium transport duct and the secondary medium transport duct connected to it and to transport a sufficient amount of the external medium containing oxidants to the combustion chamber of the afterburner chamber with the required energy.

The capacity of the combustion chamber of the recoil brake in relation to the gunpowder load of the cartridge and the measurements of the barrel must be chosen so that other factors e.g. transmission performance of the barrel gas port openings, characteristics of the ejector, the flow braking effect of the muzzle of the gun which have influence on the proceedings should be taken into account as a function of the varying gas pressure.

The afterburner must work under varying circumstances. The proportion of the combustive and the oxidant in the mixture varies. Further, it must operate reliably under varying temperature and pressure conditions. In addition to the damming disc and widening typically used in afterburner chambers or instead of them other solutions are feasible, too. These may be for example a damming element which is formed from reticular incandescent bridge provided with a combustion catalyst coating, or a swirl raising wall may be used which is formed spirally on the internal superficies of the afterburner chamber after the nozzle. Behind the wall an incandescent bridge coated with catalyst is arranged in the direction of the flow.

In a possible solution smooth operation of the recoil brake can be ensured by mixing combustion catalyst in the medium flowing before the afterburner chamber or before the combustion chamber or by mixing it even in the gunpowder constituting the propellant charge of the cartridge.

The variable operation ejector is built in after the combustion chamber. In order to prevent decrease in the vacuum in the mixed medium transport duct after the previous working period a bolt may be used which changes or closes its cross-sectional area. In this manner decrease in the vacuum caused by the medium flowing after the gases from the blow pipe can be avoided. Otherwise the vacuum generated in the drive mechanism would also be decreased which would hinder the combustion chamber from being filled with oxidant. If the bolt is not fixed rigidly its movement relative to the mixed medium transport duct may be controlled by its own inertial mass. However, it may be controlled by the increased gas pressure in the working space through the working cylinder and its movement may be delayed by the inertness deriving from the mass of the structure. This process of controlling the suction may be combined with other mechanisms e.g. a mechanism operating the filling process.

A detailed description of a possible advantageous embodiment of the invention will be given with reference to the accompanying drawing.

FIG. 1 shows the longitudinal section of the gun provided with recoil brake according to the invention (only the barrel of the gun is shown).

In the direction of progression of the gunpowder gases the barrel 2 is provided with a barrel gas port opening 3 through which the gunpowder gases are introduced into the mixed medium transport duct 5 of the similarly positioned variable operation ejector 8. The mixed medium transport duct is connected with the external environment through a secondary medium transport duct 4. The mixed medium transport duct 5 is coupled to nozzle 9 through outward opening 6 and is directed towards combustion chamber 13. The secondary medium transport duct 4 and the mixed medium transport duct 5 together with the nozzle 9 form a variable operation ejector 8 which is arranged in the pulsating drive mechanism 10 between its combustion chamber 13 and afterburner chamber 17. Chambers 13 and 17 are connected with nozzle 9. A bolt 7 may be arranged in the mixed medium transport duct 5 of the variable operation ejector 8. In the combustion chamber 13 of the pulsating reactive drive mechanism 10 provided with an afterburner chamber 17 an intake opening 11 having a mechanic valve 12 is provided advantageously opposite to the variable operation ejector 8 and in the afterburner chamber 17 elements containing combustion activating catalyst 16 may be used instead of or in addition to the damming disc 15. Further, the gun provided with recoil brake 14 has a blow pipe 18 arranged following the afterburner chamber through which the combustion product can be led out.

During the method for improving the efficiency of the recoil brake the following steps are taken: The gunpowder gases still containing combustibles are guided from barrel 2 to the mixed medium transport duct 5 of the variable operation ejector 8 through the barrel gas port opening(s). With the gunpowder gas that is with the primary medium flowing rapidly in the mixed medium transport duct 5 by means of the pulse change between the mediums external oxidizing medium i.e. a mixed medium is transported from the secondary medium transport duct 4 through nozzle 9 forming a part of the variable operation ejector 8 to the combustion chamber 13 of the pulsating reactive drive mechanism. As long as the pressure is higher in the barrel 2 than in the combustion chamber 13 the flow proceeds from the barrel gas openings 3 towards the combustion chamber 13 and medium flows even from afterburner chamber 17 towards combustion chamber 13 through nozzle 9. For the time of charging the combustion chamber 13 as long as the energy of the mixed medium flowing from the direction of barrel 2 is higher, this mixed medium is compressed into combustion chamber 13 by means of the ram pressure of the gases and the outflow from combustion chamber 13 is prevented in the same manner. The described charging operation is the first operating state of the variable operation ejector 8. To effectuate the favourably rapid medium flow from the combustion chamber 13 towards the afterburner chamber 17 through the nozzle 9 high pressure must be created in combustion chamber 13. To this charging of the combustion chamber 13 with the mixed medium flowing from the direction of the barrel 2 is not started until the pressure in the combustion chamber 13 of the pulsating reactive drive mechanism 10 provided with an afterburner chamber 17 becomes equal to the pressure of the external environment. In this manner not only a maximum amount of medium containing external oxidant can be introduced by the pulsating reactive drive mechanism 10 provided with the afterburner chamber 17, but as a result of this the mixed medium arriving from the direction of barrel 2 and containing low amount of oxidants combines later, that is, the connection with the medium being in the combustion chamber 13 containing oxidants is established later. In this manner the potential energy of the gunpowder gas is effective for a longer time and a higher amount of mixed medium may be introduced into the combustion chamber 13 from the direction of barrel 2 resulting in a more rapid combustion and higher pressure. Together with the combustion product catalysts or materials containing other oxidants in addition to air may also be introduced into combustion chamber 13. In addition to the combustion product gases (which can be referred to as a new primary medium) flowing from the combustion chamber 13 through nozzle 9 further medium containing external oxidant is pumped and compressed into afterburner chamber 17 by means of the variable operation ejector 8. During this the medium containing the oxidant is pumped through the mixed medium transport duct 5 and the secondary medium transport duct 4 into the gunpowder gas flowing from barrel 2. This is the second operating state of the variable operation ejector 8. In the interest of smooth operation in the afterburner chamber 17 oxidizing catalyst may be used at the damming disc 15 or on the internal superficies of afterburner chamber 17. This is advantageous because the mixture flowing through nozzle 9 towards the direction of afterburner chamber 17 contains little combustible; and contains much neutral combustion product considering the little amount of oxidant. In addition, the pressure in afterburner chamber 17 is not constant. Finally, the combustion product gases are exhausted through blow pipe 18.

An advantage of the invention is that delay of the braking effect is smaller. The efficiency of the recoil brake in relation to its mass is improved.

The invention claimed is:

1. A method for improving efficiency of a recoil brake associated with a gun barrel (2) of a gun, said recoil brake defining a combustion chamber (13) and an afterburner chamber (17) in confined communication with a mixed medium transport duct (5) aligned with the gun barrel (2), which method comprises the steps of:

combining in the mixed medium transport duct gunpowder gases from the gun barrel and containing combustibles with an oxidant to produce a mixed medium;

compressing the mixed medium into the combustion chamber (13) by means of ram pressure sufficient to initiate combustion and to produce a first combustion product;

driving the first combustion product by pressure created in the combustion chamber (13) to the afterburner chamber (17) through a nozzle further compressing the first combustion product;

introducing an additional oxidant through the nozzle into the afterburner chamber and producing a second combustion product in the afterburner chamber, and exhausting the second combustion product from the afterburner chamber through a blow pipe (18).

2. The method according to claim 1 wherein an oxidizing catalyst is introduced into the combustion chamber together with the oxidant.

3. The method according to claim 1 wherein an oxidizing catalyst is introduced into the afterburner chamber.

4. The method according to claim 1 wherein an oxidizing catalyst is introduced into the afterburner chamber together with the additional oxidant.

5. A gun comprising:

a barrel and a recoil brake attached to the barrel (2);

the barrel (2) defining at least one gunpowder gas port opening (3) in vicinity of a muzzle end portion of the barrel (2);

the recoil brake defining a combustion chamber (13) and an elongated afterburner chamber (17) which terminates at one end in a nozzle (9) in flow communication with the combustion chamber and terminates in an end opposite said one end in a blowpipe (18) aligned with the gun barrel (2);

a medium transport duct (5) positioned between the nozzle (9) and the at least one gas port opening (3) in open flow communication, positioned to receive gunpowder gases mixed with an oxidant, and configured as a Laval nozzle.

* * * * *